United States Patent [19]

Kukucka et al.

[11] Patent Number: 4,603,971

[45] Date of Patent: Aug. 5, 1986

[54] FINISHER MODE SWITCHING

[75] Inventors: William P. Kukucka; Robert L. Sklut, both of Webster; John F. Gauronski, Rochester, all of N.Y.

[73] Assignee: Xerox Corporation, Stamford, Conn.

[21] Appl. No.: 651,500

[22] Filed: Sep. 17, 1984

[51] Int. Cl.[4] ..... G03G 15/00; G03G 21/00

[52] U.S. Cl. ..... 355/133; 270/53; 355/14 R

[58] Field of Search ..... 355/3 R, 3 SH, 14 SH, 355/14 R, 133; 414/53, 904; 227/14; 270/53; 412/6, 8, 33, 36, 37

[56] References Cited

U.S. PATENT DOCUMENTS

| | | | |
|---|---|---|---|
| 3,793,016 | 2/1974 | Eichorn | 355/3 R X |
| 3,794,550 | 2/1974 | Taillie | 161/147 |
| 4,012,032 | 3/1977 | Rogers | 271/64 |
| 4,099,860 | 7/1978 | Connin | 355/14 |
| 4,213,694 | 7/1980 | Kuseski | 355/26 |
| 4,273,439 | 6/1981 | Markham et al. | 355/14 |
| 4,297,025 | 10/1981 | Bach et al. | 355/14 |
| 4,329,046 | 5/1982 | Burkett et al. | 355/77 |
| 4,403,850 | 9/1983 | Masuda | 355/14 |

*Primary Examiner*—Fred L. Braun

*Attorney, Agent, or Firm*—R. F. Chapuran

[57] ABSTRACT

A reproduction or printing machine including a finisher having a stack mode, a staple set mode, and a bound set mode and a tray for receiving copy sheets delivered to the finisher to be operated in any of these modes. The reproduction machine includes a controller for instructing the finisher to change from a first mode to a second mode and an operating panel having a switch to initiate the change. After initiation of the mode change at the operator panel, the controller delays by a first time period the instruction to the finisher to change the mode of operation and, also, delays by a second time period the transfer of the copy sheets to the tray in the finisher. The second time period delay depends upon the finishing mode the machine is running in and the requested new finishing mode.

8 Claims, 5 Drawing Figures

65
59
67
66
62
61
63
56
54
55
60
34
35
52
46
44
32
30
86
48
50
40
42
68
14
22
12
28
15
17
10
26

FINISHER MODE SWITCHING

This invention relates to a finisher in a reproduction machine having a plurality of finishing modes and in particular, to switching between the various finishing modes.

It is known in the prior art to provide finishers for reproduction machines with more than one mode of operation. For example, it is known for a reproduction machine to produce in an output tray a stack of documents, unstapled sets of documents, or stapled sets of documents. It is also known as shown in U.S. Pat. No. 4,329,046 to be able to temporarily halt the reproduction machine upon the output tray reaching a predetermined capacity depending upon the mode of operation and to resume operation upon emptying the contents of the output tray.

The prior art also shows many attempts to increase the efficiency and operation of reproduction machine, particularly machines for high speed, high volume runs. For example, U.S. Pat. No. 3,871,643 teaches a sorter system having two sorter sections. In particular, the control switches from one section to the next to continue a reproduction requirement. In addition, the bins in both sections of the sorter often contain copy sheets, yet, the job requirement has not been completed. In this situation, upon removal of copy sheets in one of the sections, the reproduction machine will resume operation. U.S. Pat. No. 4,012,032 describes a copy sheet handling system having a copy sheet receiving tray for use in operating in a non-collate mode and a plurality of collator bins for operating in the collate mode. In this system, the control senses when the non-collate tray has reached capacity and automatically directs documents to the collate bins. Similarly, if operating in the collate mode and a requirement exceeds the number of collator bins, a portion of the job requirement is stacked in the non-collate tray.

It is also known in the prior art to be able to operate machines in alternate modes. For example, U.S. Pat. No. 4,099,860 shows a priority interrupt scheme in which a lower priority production run is interrupted. The production run information for the lower priority run is stored in memory and the machine proceeds with a higher priority production run. After the higher priority run is completed, the priority interrupt apparatus initiates the completion of the remaining portion of the lower priority production run. IBM Technical Disclosure Bulletin, Volume 18, No. 10, March 1976, teaches a copier having the capability of handling selected functions such as collation, stapling, duplexing, magnification or reduction, and copy background control. Various functions can be programmed into the machine and also, if desired, the machine can be interrupted to perform a new job. U.S. Pat. No. 4,403,850 discloses the means to alternate between optical scan modes and U.S. Pat. No. 4,213,694 shows a first mode for printing documents that is interruptable by a second mode for making copies. In addition, U.S. Pat. No. 4,300,829 shows a single magnification-reduction button for setting a reproduction machine to various decrete magnification reduction modes. However, upon setting a particular reduction, magnification mode, there is a deferred movement of the system lens to offset any needless dithering of the machine before the appropriate selection is made. In addition, U.S. Pat. No's. 4,273,439 and 4,297,025 describe mode changes in the middle of a run.

A difficulty with the prior art systems, however, is often the need to stop the machine or complete a first finishing requirement before switching to a second finishing requirement. After a reproduction job has been started, however, it is often more efficient and convenient to be able to change finishing modes without stopping the machine. On the other hand, in changing from one mode to another mode there are often certain timing and position constraints in the process that could result in a machine malfunction. For example, is the machine if producing collated, unstapled sets and it is desired to change the machine to produce collated stapled sets, it is usually necessary to change the machine timing. Extra time is needed to be able to staple and eject each set, whereas there is no extra time needed merely to collate the sets. If the mode change to stapled sets were done immediately, without a time delay to allow for the stapling of the sets, there would not be sufficient time to staple the sets and the machine would jam.

It would be desirable, therefore, to be able to change finishing modes while the finisher is operating without jamming the machine. It would also be desirable for the mode change system to immediately accept the change on the operator panel, but to internally delay the completion of the mode change until the finisher has reached a suitable mode change condition.

It is an object of the present invention, therefore, to provide a new and improved machine finisher mode change system. It is another object of the present invention to be able to change the finisher mode in a reproduction machine while the finisher is still running without jamming the machine. It is another object of the present invention to delay a mode change in a reproduction machine while the finisher is operating until finisher reaches a mode change condition. It is another object of the present invention to provide a mode change in an operating machine finisher by both delaying the implementation of the mode change in the finisher station and also, altering the time of delivery of copy sheets to the finisher.

Further advantages of the present invention will become apparent as the following description proceeds and the features characterizing the invention will be pointed out with particularity in the claims annexed to and forming a part of this specification.

Briefly, the present invention is concerned with a reproduction machine including a finisher having a stack mode, a staple set mode, and a kound set mode and atray for receiving copy sheets delivered to the finisher to be operated in either of these modes. The reproduction machine includes a controller for instructing the finisher to change from a first mode to a second mode and an operating panel havinv a switch to initiate the change. After initiation of the mode change at the operator panel, the controller delays by a first time period the instruction to the finisher to change the mode of operation and also, delays by a second time period the transfer of the copy sheets to the tray in the finisher. The second time period delay depends upon the finishing jode the machine is running in and the requested new finishing mode.

For a better understanding of the present invention, reference numerals have been applied to like part wherein.

Figure 1:
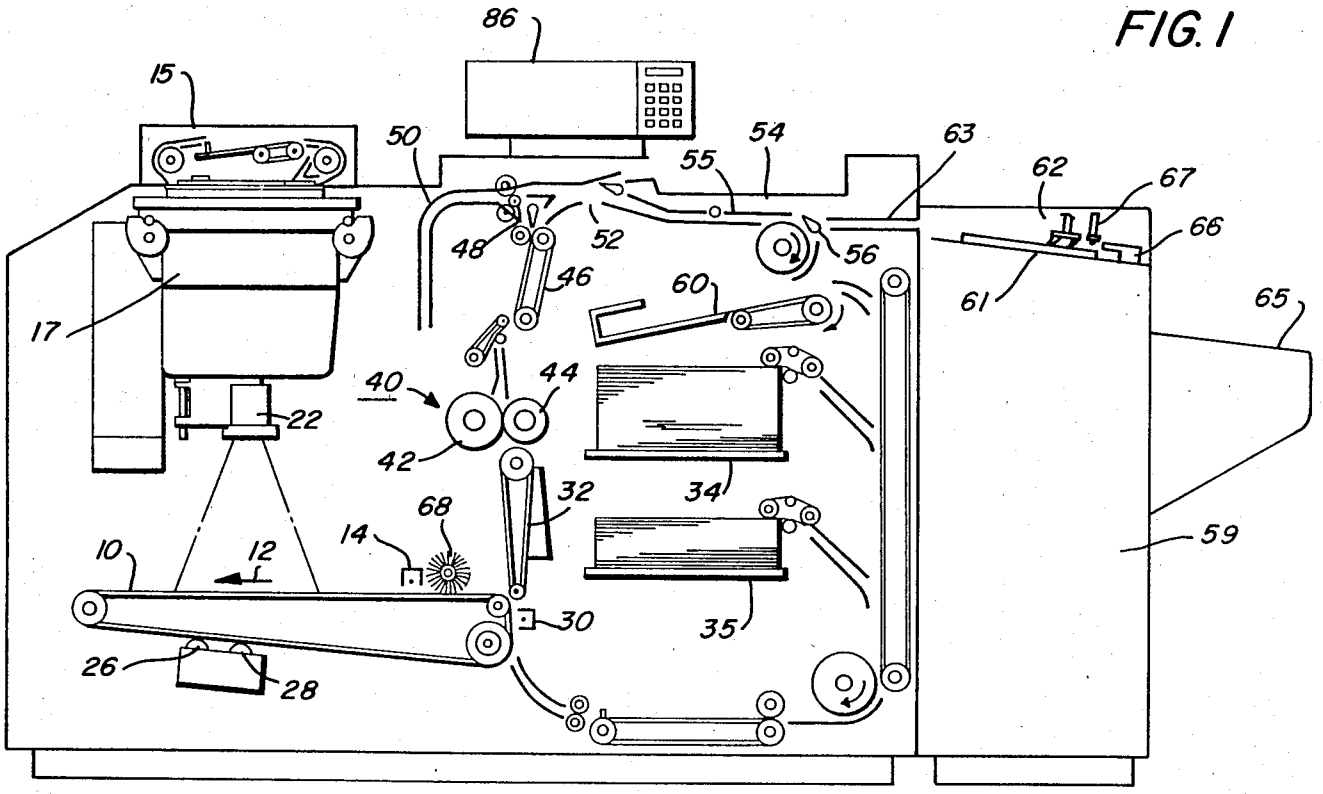
FIG. 1 is an elevational view of an exemplary reproduction machine incorporating the present invention.

With reference to FIG. 1, there is shown an electrophotographic printing or reproduction machine employing a belt 10 having a photoconductive surface. Belt 10 moves in the direction of arrow 12 to advance successive portions of the photoconductive surface throught various processing stations, starting with a charging station having a corona generating device 14. The corona generating device charges the photoconductive surface to a relatively high substantially uniform potential.

The charged portion of the photoconductive surface is then advanced through an imaging station. At the imaging station, a document handling unit 15, positions an original document facedown over exposure system 17. The light rays reflected from the document are transmitted through lens 22. Lens 22 focuses the light image of original document onto the charged portion of the photoconductive surface of belt 10 to selectively dissipate the charge. This records an electrostatic latent image on the photoconductive surface corresponding to the informational areas contained within the original document.

The belt 10 then advances to a developer station. At the developer station, a pair of magnetic brush developer rollers 26 and 28 advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 34 or 35 to the transfer station. After transfer, conveyor 32 advances the sheets to a fusing station. The fusing station includes a fuser assembly 40 for permanently affixing the transferred powder image to the copy sheet. Preferably, fuser assembly 40 includes a heated fuser roller 42 and back-up roller 44 with the sheet passing between fuser roller 42 and back-up roller 44 with the powder image contacting fuser roller 42.

After fusing, conveyor 46 transports the sheets to gate 48 which functions as an inverter selector. Depending upon the position of gate 48, the copy sheets will either be deflected into a second sheet inverter 50 or bypass sheet inverter 50 and be fed directly onto a second gate 52. Second gate 52 deflects the sheet directly into an output tray 54 or deflects the sheet into a transport path 55 which carries them on without inversion to a third gate 56. Gate 56 either passes the sheets directly on without inversion into the output path of the copier to the finisher 59, or deflects the sheets into a duplex inverter roll transport to duplex tray 60. Duplex tray 60 provides intermediate of buffer storage for those sheets which have been printed on one side for printing on the opposite side.

After the copy sheet is separated from the photoconductive surface of belt 10, some residual particles remain adhering to belt 10. These residual particles are removed from the photoconductive surface thereof at a cleaning station. The cleaning station includes a rotatably mounted brush 68 in contact with the photoconductive surface of belt 10. A controller including console panel 86, is electrically connected to the various components of the printing machine.

Figure 2:
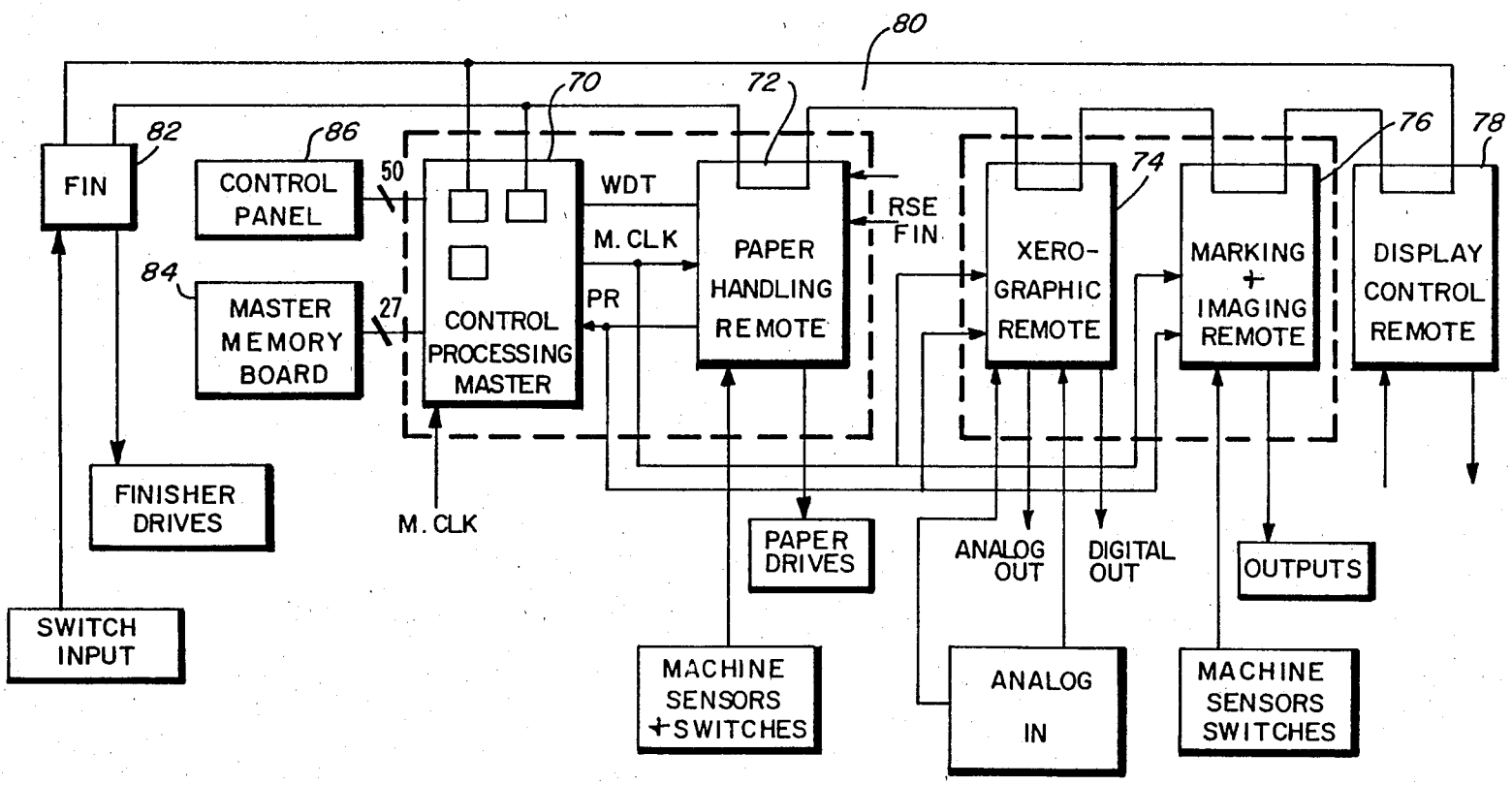
FIG. 2 is a block diagram of the controller incorporating the present invention.

With reference to FIG. 2, there is shown in further detail the controller of the reproduction or printing machine. In particular, there is shown a control processing master (CPM) control board 70 for communicating information to and from all the other control boards, in particular, the Paper Handling Remote (PHR) control board 72 controlling the operation of all the paper handling subsystems such as paper feed, registration and output transports.

Other control boards are the Xerographic Remote (XER) control board 74 for monitoring and controlling the xerographic process, in particular the analog signals, the Marking and Imaging Remote (MIR) control board 76 for controlling the operation of the optics and xerographic subsystems, in particular the digital signals. A Display Control (DCR) control board 78 is also connected to the CPM control board 70 providing operation and diagnostic information on both an alphanumeric and liquid crystal display. A finisher control board 82 controls operation of the machine finisher. Interconnecting the control boards is a shared communication line 80, preferably a shielded coaxial cable or twisted pair with suitable communication protocol similar to that used in a Xerox Ethernet ® type communication system. For a more detailed explanation of the control, reference is made to Ser. No. 420,995 filed Sept. 21, 1982, now U.S. Pat. No. 4,521,847, Ser. No. 421,007 filed Sept. 21, 1982, and Ser. No. 421,011 filed Sept. 21, 1982, now U.S. Pat. No. 4,514,846, and incorporated herein.

Each of the controller boards preferably includes an Intel 8085 microprocessor with suitable Random Access Memory (RAM) and some form of Read Only Memory such as ROMs or EPROMs. Also, interconnected to the CPM control board is a Master Memory Board (MMB) 84 with suitable ROMs/EPROMs to control normal machine operation and a control panel board 86 for entering job selections and diagnostic programs. Also, contained in the CPM board 70 is suitable nonvolatile memory. All of the control boards, other then the CPM control board, are generally referred to as remote control boards.

In a preferred embodiment, the control panel board 86 is directly connected to the CPM control board 70 over a seventy line wire and the memory board 84 is connected to the CPM control board 70 over a thirty-six line wire. Preferably, the Master Memory Board 84 contains 56K byte memory and the CPM control board 70 includes 2K ROM/EPROM, 6K RAM, and a 512 byte nonvolatile memory. The PHR control board 72 includes 1K RAM and 4K ROM/EPROM and preferably handles various inputs and outputs. The XER control board 74 handles twenty-four analog inputs and provides twelve analog output signals and eight digital output signals and includes 4K ROM/EPROM and 1K RAM. The MIR board 76 handles thirteen inputs and seventeen outputs and has 4K ROM/EPROM and 1K RAM.

As illustrated, the PHR, XER AND MIR boards receive various switch and sensor information from the printing machine and provide various drive and activation signals, such as to clutches, motors and lamps in the operation of the printing machine. It should be understood that the control of various types of machines and processes are contemplated within the scope of this invention.

Figure 3:
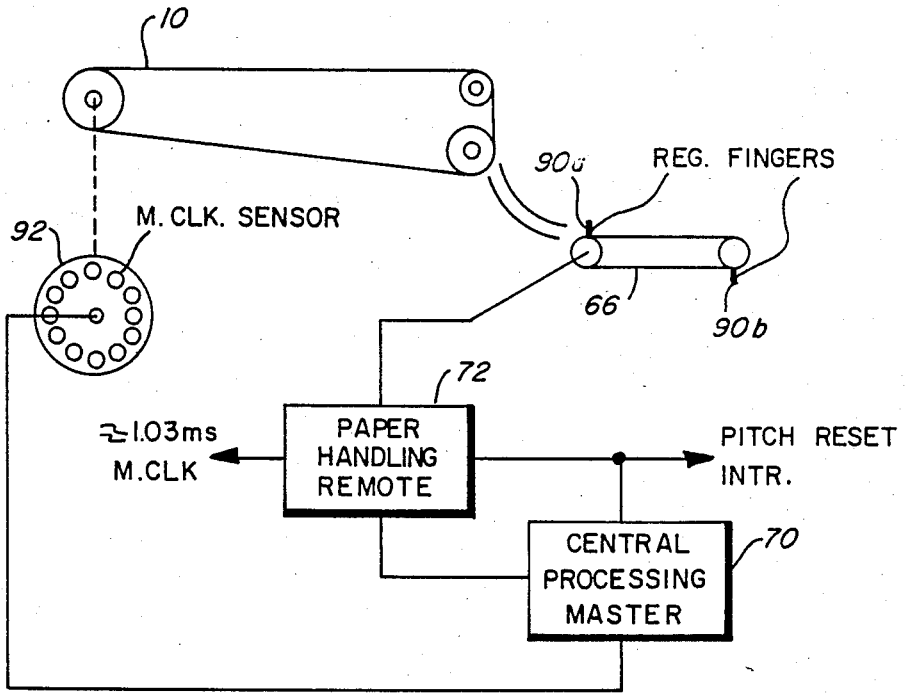
FIG. 3 illustrates the timing system for the machine of FIG. 1.

A master timing signal, called a timing reset or Pitch Reset (PR) signal, as shown in FIG. 2, is generated by PHR board 72 and used by the CPM, PHR, MIR and XER control boards 70, 72, 74 and 76. With reference to FIG. 3, the Pitch Reset (PR) signal is generated in response to a sensed registration finger. Two registration fingers 90*a*, 90*b* on conveyor or registration transport 66 activate a suitable (not shown) sensor to produce the registration finger signal. The registration finger signal is conveyed to suitable control logic on the PHR control board 72.

In addition, a Machine Clock signal (MCLK) is conveyed to PHR 72 via the CPM control board 70 to suitable control logic. In response to predetermined MCLK signals, the pitch reset signal is conveyed to the CPM board 70 and the MIR and the XER remotes 74, 76. The Machine clock signal is generated by a timing disk 92 or Machine Clock sensor connected to the main drive of the machine. The Machine clock signal allows the remote control boards to receive actual machine speed timing information.

The timing disk 92 rotation generates approximately 1,000 machine clock pulses per second. A registration finger sensed signal occurs once for each paper feed and there are approximately 830 machine clock counts for every registration finger sensed signal as shown in FIG. 3. A belt hole pulse is also provided to synchronize the seam on the photoreceptor belt 10 with the transfer station to assure that images are not projected onto the seam of the photoreceptor belt.

Figure 4:
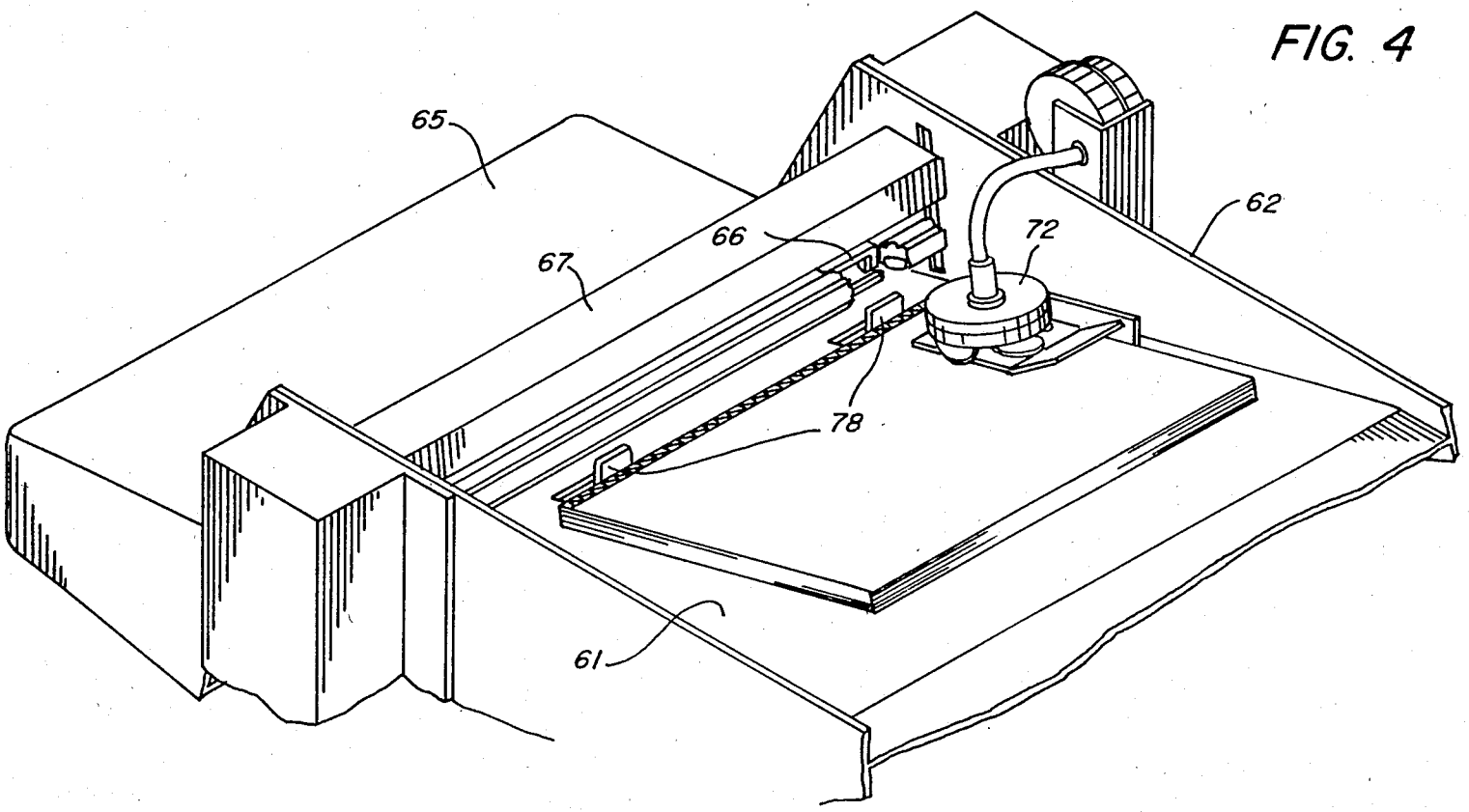
FIG. 4 illustrates the machine finisher in more detail.

With reference to FIGS. 1 and 4, in accordance with the present invention, the gate 56 deflects imaged copy sheets to the stitcher/binder 62 of the finisher 59. In particular, the sheets are conveyed to the compiler tray 61 via the transport 63. The output of the compiler tray 61 is to the stacker tray 65. The stitcher/binder 62 includes a stitcher illustrated at 66 and a binder illustrated at 67. Preferably, the binder 67 is brought into a bind position at the edge of tray 61 from a home position when a bind operation is required, whereas the stitcher head is already in a operation position when a stitch operation is required. The compiler tray 61 assembles the copies into a registered set. Depending upon the selection of the operator, the set is then either stapled or bound, or remains unstapled and unbound. The collated sets, whether bound, stapled or not are ejected from the compiler tray 61 into the stacker tray 65 which receives the sets and offsets each set in the tray.

With reference to FIG. 4, copies entering the stitcher/binder 62 are moved to the registration tabs 78 and the swiper 72 accurately positions the copies one on top of another. As copies enter the stitcher/binder 62 a (not shown) input jam switch provides a signal to the finisher board 82 that the copy arrived at the correct time.

If the staple feature is selected, the stitcher control allows enough time for the last copy of the set to reach the registration fingers. Neither the binder nor the stitcher apparatus form any part of the present invention. A typical operation for a stitcher would be to provide a control signal to a stitcher clutch coupling drive to a stitcher cam and to a clincher cam. The stitcher cam moves the stitcher head to form a wire to make a staple and drive the staple down through the set of copies. The clincher cam moves the clincher to bend the feet of the staple towards each other, completing the stapling process. In a similar manner, if the operator selects the binder feature, the binder assembly 67 is positioned at the edge of the stack to successively glue each copy sheet entering the compiler tray to the previous copy sheet in the tray. The stapled or bounded set in the compiler tray 61 must then be ejected into the stacker tray 65. That is, in the binder operation, each sheet is collected and corner registered as it enters the compiler tray 61. Adhesive is dispensed on the top sheet and the sheets are tamped in the compiler. Since the binder 67 must be positioned in the finisher 59 to bind the sets, if a stitch operation is required with the binder in the binding position, the binder assembly must be repositioned. At the end of the set, the set is ejected from the compiler, to the stacker tray 65. After the set is completed, a (not shown) eject clutch couples drive to an eject pinch roll cam and a registration finger cam. The registration finger cam pushes on a retract mechanism causing the registration tabs 78, to move out of the way of the copy path. The eject pinch roll cam causes the eject pinch roll to move down onto the set of copies and the set ejects into the stacker tray 65. In operation, whether or not to be bound or stitched, all sets in stacks are collected and corner edge registered in the compiler tray 61.

Figure 5:
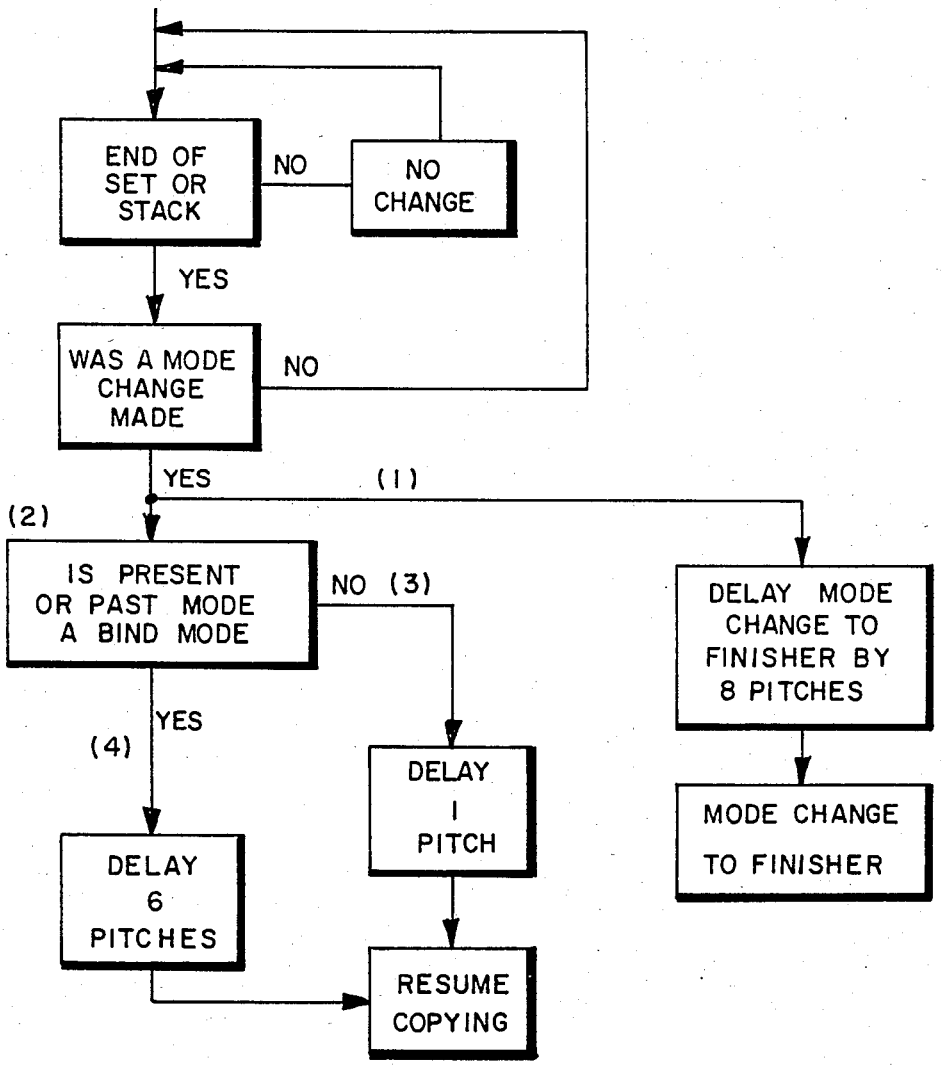
FIG. 5 is a flow chart of the finisher control, in accordance with the present invention.

In accordance with the present invention, reference is made to FIG. 5 illustrating the control in changing between the stack, staple, and bind finishing mode while the finisher is in operation. There is a constant monitoring of the control console mode change switches if a mode change has been selected at the completion of a finished set. Assuming the finisher is presently operating in one of these three modes, and the operator selects a different mode from the control console 86 the following sequence will occur. The CPM board 70 will acknowledge the request for a mode change from the control console 86 and check to see if the finisher operation is at the end of a set or stack. If the finisher operation is not at the end of the set there will be no change affected and the finisher operation will continue.

If the operation is at the end of a set and there has been a mode change requested, the control follows two separate paths. In path 1, as illustrated in FIG. 5, even though the control has sensed the mode change, there is a time delay of 8 pitches. A time period of one pitch is the time period between successive copy sheets or images in the reproduction cycle. This 8 pitch delay is the time period before the instruction to switch modes is conveyed from the controller to the finisher control, i.e. from the CPM board 70 to the finisher board 82. Regardless of the current finisher mode and the requested finisher mode, there is a delay of eight pitches before the finisher control is instructed to alter the timing sequence in accordance with the requested mode. That is, time must be allowed to finish the current set and make the required mechanical changes in the finisher.

In path 2, as illustrated in FIG. 5, it is necessary to alter the time of arrival of copy sheets to the compiler tray 61. That is, a stack mode will require a first timing sequence. On the other hand, the staple mode requires an extra time period or pitch for the system to have time to staple the set before it is ejected into the stack tray 65. Similarly, a different time period is needed when the system is in the bind mode for the finisher to have time to bind the stack before it is ejected. With reference to path 3, if neither the current mode or the requested mode is the bind mode, there is a delay of one pitch before the finisher continues operation. That is, if the machine finisher is going from the stack mode to the staple mode, it is necessary to delay the system one pitch to allow the system to have time for the stapler to actually staple the set before it is ejected into the stacking tray. If on the other hand, with reference to path 4, the system is changing from either the stack or staple mode to the bind mode, it is necessary to delay six pitches to convey the last set to the stacker and to move the bind mechanism.

While it has been illustrated and described what is, at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. In a reproduction machine having a photosensitive member and a plurality of operating components including a finisher and a control panel cooperating with one another and the photosensitive member in time periods determined by pitches to produce impressions on copy sheets, the finisher including a staple mode to staple a set of copy sheets together and a bind mode to bind a set of copy sheets together, the method of changing from the staple mode to the bind mode or from the bind mode to the staple mode comprising the steps of:

initiating a mode change at the control panel while the machine is operating in either the bind mode or the staple mode, determining if the present mode or the previous mode was a bind mode, delaying the feeding of copy sheets in the finisher for a first given time period, delaying the mode change initiation by a second time period different from said first given time period, and resuming operation of the finisher in the new mode.

2. The method of claim 1 wherein said first given time period is a delay of six pitches.

3. The method of claim 1 wherein said second time period different from said first given time period is a delay of eight pitches.

4. In a reproduction machine having a finisher including a stack mode, a staple mode, and a bind mode, the method of operating the reproduction machine to be able to change finisher modes from a first mode to a second mode while the machine is operating in a first mode including the steps:

initiating a mode change, determining if the first mode or the second mode is the bind mode, if neither the first mode or the second mode is the bind mode, then delaying operation of the finisher for a first given period of time, and if the first mode or the second mode is the bind mode, then delaying operation of the finisher for a second time period.

5. The method of claim 4 wherein the first time period is a one pitch time delay and the second time period is a six pitch time delay.

6. In a reproduction machine having a finisher including a first mode and a second mode and a tray for receiving copy sheets delivered to the finisher to be operated on in either the first mode or the second mode, the reproduction machine including a controller for instructing the finisher to change from the first to the second mode and an operating panel having a switch to initiate a change between the first and a second mode, the method of changing from the first to the second mode including the steps of:

initiating a mode change at the operator panel, the controller determining that a mode change has been initiated, the controller delaying by a given time period the instruction to the finisher to change the mode of operation, and the controller delaying by a second time period the transfer of copy sheets to the tray in the finisher.

7. The method of claim 6 including three finisher modes of operation, a stack mode, a staple mode, and a bind mode wherein upon initiating a mode change, the controller determines that either the present or the previous mode was a bind mode.

8. The method of claim 7 wherein if the present or previous finisher mode was a bind mode, the step of delaying the transfer of copy sheets to the tray for a first time period and if the present or previous finisher mode was not a bind mode, the step of delaying the transfer of copy sheets to the finisher tray for a second time period.

* * * * *